US008354210B2

(12) United States Patent
Takaki et al.

(10) Patent No.: US 8,354,210 B2
(45) Date of Patent: Jan. 15, 2013

(54) ELECTROPHOTOGRAPHIC PHOTOCONDUCTOR AND A METHOD OF MANUFACTURING THE SAME

(75) Inventors: Ikuo Takaki, Matsumoto (JP); Yoichi Nakamura, Matsumoto (JP); Kazuki Nebashi, Matsumoto (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 785 days.

(21) Appl. No.: 12/225,888

(22) PCT Filed: Apr. 5, 2007

(86) PCT No.: PCT/JP2007/058017

§ 371 (c)(1),
(2), (4) Date: Sep. 22, 2009

(87) PCT Pub. No.: WO2007/117029

PCT Pub. Date: Oct. 18, 2007

(65) Prior Publication Data

US 2010/0028791 A1 Feb. 4, 2010

(30) Foreign Application Priority Data

Apr. 7, 2006 (JP) ..... 2006-106602

(51) Int. Cl.
*G03G 5/047* (2006.01)
*G03G 5/14* (2006.01)
*G03G 5/147* (2006.01)

(52) U.S. Cl. ..... 430/58.05; 430/59.1; 430/60; 430/64; 430/56; 430/66; 430/131; 430/132; 430/133

(58) Field of Classification Search ..... 430/60, 430/64, 56, 59.1, 58.08, 66, 133, 131, 132, 430/58.05
See application file for complete search history.

(56) References Cited

U.S. PATENT DOCUMENTS

| | | | | |
|---|---|---|---|---|
| 4,923,783 | A | 5/1990 | Kobayashi et al. | |
| 5,026,756 | A * | 6/1991 | Arendt | 524/293 |
| 5,534,575 | A * | 7/1996 | Foster et al. | 524/270 |
| 5,795,695 | A * | 8/1998 | Malhotra et al. | 430/124.52 |
| 6,099,631 | A * | 8/2000 | Tregub et al. | 106/31.85 |
| 6,428,878 | B1 * | 8/2002 | Kronzer | 428/32.6 |
| 2003/0100645 | A1 * | 5/2003 | Ahmed et al. | 524/306 |
| 2007/0037926 | A1 * | 2/2007 | Olsen et al. | 524/569 |

FOREIGN PATENT DOCUMENTS

| | | |
|---|---|---|
| JP | S57-122444 | 7/1982 |
| JP | S63-018355 | 1/1988 |
| JP | H06-075394 | 3/1994 |
| JP | H06-118678 | 4/1994 |
| JP | H07-168381 | 7/1995 |
| JP | H08-272126 | 10/1996 |
| JP | H11-288113 | 10/1999 |
| JP | 2001-013708 | 1/2001 |
| JP | 2002-268250 | 9/2002 |
| JP | 2002-287388 | 10/2002 |
| JP | 2004-199051 | 7/2004 |
| JP | 2004-206109 | 7/2004 |
| JP | 2004-226637 | 8/2004 |

OTHER PUBLICATIONS

Benzoflex ® 352 Product Information Bulletin, Velsicol Chemical Corporation (no date).*
Office Action from Russia Patent Office in a counterpart application, Application No. 2008144112/04(057533), issued on Apr. 20, 2010.
Office Action from Japnese Patent Office in a counterpart application, Application No. 2006-106602, issued on Dec. 21, 2010.

* cited by examiner

*Primary Examiner* — Christopher Rodee
(74) *Attorney, Agent, or Firm* — Rabin & Berdo, P.C.

(57) ABSTRACT

An electrophotographic photoconductor that stabilizes electrical performances and prevents generation of image faults such as memories, irrespective of types of organic materials of resin binder and charge transport material, and variation of temperature and humidity of the operation environment. An electrophotographic photoconductor includes at least a photosensitive layer formed over a conductive substrate, wherein the photosensitive layer contains a cyclohexane dimethanol-diaryl ester compound represented by the formula (I):

(I)

in formula (I), each of $R^1$ through $R^{10}$ represents independently, a hydrogen atom, a halogen atom, a substituted or unsubstituted alkyl group of carbon number of from 1 to 5, a substituted or unsubstituted aryl group, or a substituted or unsubstituted alkoxy group of carbon number of from 1 to 5.

18 Claims, 1 Drawing Sheet

ELECTROPHOTOGRAPHIC PHOTOCONDUCTOR AND A METHOD OF MANUFACTURING THE SAME

CROSS-REFERENCE TO RELATED APPLICATIONS

This Application is the U.S. national stage of PCT Application No. PCT/JP2007/058017 filed on Apr. 5, 2007.

BACKGROUND OF THE INVENTION

1. Field of the Invention

The present invention relates to an electrophotographic photoconductor (hereinafter also simply referred to as "a photoconductor") used in printers, copiers, facsimile machines, or the like in an electrophotographic system; and in particular, to an electrophotographic photoconductor having excellent durability in repeated printings and good resistance to gases, which is achieved by improvement of an additive material. The invention also relates to a method of manufacturing such a photoconductor.

2. Description of the Related Art

An electrophotographic photoconductor generally needs functions of retaining surface charges in the dark, generating charges upon receipt of light, and transporting the charges upon the receipt of light. There are two types of photoconductors: a single layer type photoconductor in which all these functions are performed in a single layer, and a laminated layer type photoconductor consisting of function-separated layers, the layers including a layer primarily contributing to charge generation and a layer contributing to retaining surface charges in the dark and transporting charges upon receipt of light.

The image formation in electrophotography using an electrophotographic photoconductor can be carried out by the Carlson process, for example. This process includes electrification of the photoconductor in the dark, formation of latent images of characters or pictures of the original on the charged surface of the photoconductor, development of the formed latent images by toners, and transferring and fixing of the developed toner images on a carrier medium of paper or the like. After the toner image transfer, the photoconductor is recycled through elimination of remained toners and residual electric charges.

Materials that can be used in electrophotographic photoconductors includes: inorganic photoconductive materials such as selenium, selenium alloy, zinc oxide, and cadmium sulfide; and organic photoconductive substances such as poly-N-vinylcarbazole, 9,10-anthracene-diol polyester, pyrazoline, hydrazone, stylbene, butadiene, benzidine, phthalocyanine, and bisazo compounds. These materials are used by dispersing in a resin binder, or by vacuum evaporation or sublimation.

With increased printing sheets accompanying construction of office network and rapid development of electrophotographic light printers in recent years, printers of electrophotographic system have been more strongly requiring high durability, high sensitivity, and quick responsiveness. Also required is minimal image performance variation that can be caused by the effect of ozone or NOx generated in the apparatus, and the influence of operating environment (temperature and humidity).

Conventional photoconductors, however, do not meet the requirements satisfactorily and have problems as follows.

One problem is wear resistance. Recently, high speed printers have been wide spread corresponding to introduction of the tandem development procedure in printers and copiers of the types even for color printing in addition to for monochromatic printing. In color printing, in particular, high positional accuracy of the images, as well as high resolution, has been occupying an important position among required specifications. The surface of a photoconductor is worn by repeated printings due to friction with paper, rollers, and a blade. If the wear is substantial, it is difficult to print images with high resolution and high positional accuracy. Although studies for improving the wear resistance have been extensively made so far, they are not yet satisfactory.

Among gases that are generated in an apparatus and affect the photoconductor, ozone is well known. Ozone is generated by corona discharge in a charger and a roller charger. The ozone that is remained or stayed in the apparatus and to which the photoconductor is exposed, oxidizes and breaks the original structure of the organic substances composing the photoconductor. As a result, photoconductor characteristics may be remarkably deteriorated. The ozone also oxidizes nitrogen in the air generating NOx, which may modify the organic substances composing the photoconductor.

The degradation of photoconductor characteristics due to gases can be caused not only by corrosion on the surface layer but also by penetration of the gas into internal layers of the photoconductor. The outermost layer of the photoconductor may be scratched away due to friction with the parts mentioned earlier in a little or large amount. Further, harmful gas may penetrate into the photosensitive layer and destroy a structure of the organic substances in the photosensitive layer. Accordingly, preventing the harmful gases from penetrating is also one of the problems. In a color electrophotographic apparatus of tandem structure using plural photoconductors, this problem is critical because the drums positioned at different places are differently affected by the gases, generating nonuniformity in the color tone, which hardly produces satisfactory images.

Regarding the gas resistance, Japanese Unexamined Patent Publication Nos. S57-122444 and S63-18355 disclose, for the purpose of improving gas resistance, the use of antioxidants including a hindered phenol compound, a phosphorus-containing compound, a sulfur-containing compound, an amine compound, and a hindered amine compound. Japanese Unexamined Patent Publication No. 2002-268250 proposes a method using a carbonyl compound, and Japanese Unexamined Patent Publication No. 2002-287388 proposes a method using a benzoate compound or a salicylate compound. Other methods for improving the gas resistance have been proposed including: use of a specified polycarbonate resin with an additive of biphenyl (Japanese Unexamined Patent Publication No. H6-75394), a combination of a specified amine compound and a polyarylate resin (Japanese Unexamined Patent Publication No. 2004-199051), and a combination of a polyarylate resin and a compound exhibiting specified absorbance (Japanese Unexamined Patent Publication No. 2004-206109). These methods, however, do not provide photoconductors exhibiting sufficient gas resistance, or, while exhibiting satisfactory gas resistance, do not show improvement of wear resistance and do not attain satisfactory result on other performances including image memories and stability of electric potential in repeated printings.

Japanese Unexamined Patent Publication No. H08-272126 discloses that adverse effect to the photoconductor due to the gases generated around the charger can be suppressed by combining with a charge transport layer exhibiting a specified mobility and controlling the oxygen permeability coefficient below a predetermined value. Japanese Unexamined Patent Publication No. H11-288113 discloses that wear resistance and gas resistance are improved when moisture permeability is below a predetermined value. The methods of these references, however, cannot achieve desired effects unless employing the specified charge transport polymer materials, and thus, are imposed by the limitations of mobility and structure of the charge transport material. Therefore, the methods cannot sufficiently meet the needs for a variety of electrical performances.

Japanese Unexamined Patent Publication No. 2004-226637 discloses that a single layer type electrophotographic photoconductor with good gas resistance is obtained by the use of a specified diester compound having a melting point of at most 40° C. The additive of low melting point substance causes a so-called "bleeding" phenomenon when a photoconductor containing the substance is in contact with the cartridge or other parts of the main body of the apparatus for a long time, in which the compound escapes into the contacting parts. The bleeding may generate image faults and thus, fails to accomplish satisfactory effects.

Concerning variation of characteristics in operating environment, a first problem is deterioration of the image characteristic in a low temperature and low humidity environment. In a low temperature and low humidity environment in general, sensitivity of a photoconductor apparently decreases, which reveals degradation of image quality such as decrease of density of images and deterioration of gradation of halftone images. Image memory may become significant accompanying the degradation of sensitivity. In a printing process, the image recorded as a latent image in the first revolution of the drum is affected by variation of the potential in the second and later revolution of the drum. As a result, printing may occur in unnecessary places particularly in the case of printing of halftone images. This is the degradation of image quality by the image memories. Often observed examples in a low temperature and low humidity environment, in particular, are negative memories, in which light and shade of the images are reversed.

Image characteristics may also degrade in a high temperature and high humidity environment. In a high temperature and high humidity environment in general, mobility of charges in the photoconductor is larger than in a normal temperature and normal humidity environment, which may cause image defects including excessive increase of printed density and minute black spots in a wholly white image printing (fogging). The excessive increase of printed density increases toner consumption, and destructs minute gradation due to enlarged one dot diameter. In contrast to those seen in a low temperature and low humidity environment, observed examples in a high temperature and high humidity environment often are positive memories, in which light and shade of the image reflect the right printing images.

The performance degradation due to temperature and humidity are often caused by absorption and release of moisture in resin binder in the surface layer or in the charge generation material in the photosensitive layer. To address this problem, a variety of materials have been studied including: Japanese Unexamined Patent Publication No. H6-1186 and Japanese Unexamined Patent Publication No. H7-168381 disclose the containing of a specified compound in a charge generation layer; and Japanese Unexamined Patent Publication No. 2001-13708 discloses that a specified polycarbonate polymer is used for a charge transport material in a surface layer. Unfortunately, materials have not been found that can satisfactorily achieve various characteristics including the suppression of the effect of temperature and humidity on photoconductors.

Although diverse studies have been made on photoconductor materials, an electrophotographic photoconductor that sufficiently satisfies the required performances as described above has not been obtained.

It is therefore an object of the present invention to solve the above problems and provide an electrophotographic photoconductor that achieves improved stability of electrical performances and prevents generation of image faults such as memories, irrespective of the types of organic materials of the resin binder and charge transport material, and the variation of temperature and humidity of the operation environment.

BRIEF SUMMARY OF THE INVENTION

The inventors of the present invention, to deal with the above problems, focused on the structure of the resin binders used in the layers including a photosensitive layer, of the photoconductor. Resins for the surface layer of a photoconductor primarily used at present are polycarbonate resins and polyarylate resins. A photosensitive layer is formed by dissolving these resins together with functional materials in a solvent and applying the solution on a substrate by dip coating, spray coating, or the like. The resin forms a film containing and surrounding the functional material. Viewing in a scale of a molecule, the film contains voids with a size that cannot be disregarded. If the voids are large, they can cause degradation of wear resistance and worsening of electric performance due to influx and release of low-molecular gases or moisture.

If these voids generated in the film can be filled with molecules having an appropriate size, a more rigid film can be formed. Such a film can be expected to improve wear resistance and prevent the low-molecular gases and moisture from influxing and releasing in the film.

The inventors of the present invention have made extensive studies and found that a photoconductor and method are provided that can solve the above problems, by taking advantage of the function of a compound having a specified structure as indicated hereinafter that fills the voids in a scale of a molecule generated in the film in the process of forming the film from a resin.

An electrophotographic photoconductor according to the invention comprises at least a photosensitive layer formed over a conductive substrate, wherein the photosensitive layer contains a cyclohexane dimethanol-diaryl ester compound represented by the formula (I):

(I)

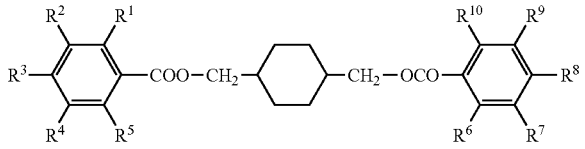

in formula (I), $R^1$ through $R^{10}$ represents independently, a hydrogen atom, a halogen atom, a substituted or unsubstituted alkyl group of carbon number of from 1 to 5, a substituted or unsubstituted aryl group, or a substituted or unsubstituted alkoxy group of carbon number of from 1 to 5.

In an invented photoconductor, when the photosensitive layer is of a laminated layer type comprising a charge generation layer and a charge transport layer, the cyclohexane dimethanol-diaryl ester compound is preferably contained in the charge generation layer or the charge transport layer. When the photosensitive layer is of a single layer type comprising a single layer, the cyclohexane dimethanol-diaryl ester compound is preferably contained in the single layer type photosensitive layer.

Another electrophotographic photoconductor according to the invention comprises at least an undercoat layer and a photosensitive layer sequentially provided on a conductive substrate, wherein the undercoat layer contains a cyclohexane dimethanol-diaryl ester compound represented by the formula (I):

(I)

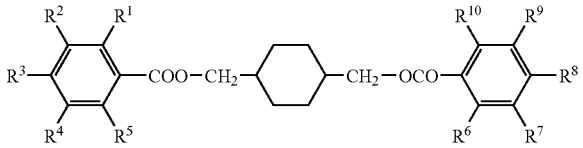

in formula (I), $R^1$ through $R^{10}$ represents independently, a hydrogen atom, a halogen atom, a substituted or unsubstituted alkyl group of carbon number of from 1 to 5, a substituted or unsubstituted aryl group, or a substituted or unsubstituted alkoxy group of carbon number of from 1 to 5.

A yet another electrophotographic photoconductor comprises at least a photosensitive layer and a surface protection layer sequentially formed over a conductive substrate, wherein the surface protection layer contains a cyclohexane dimethanol-diaryl ester compound represented by the formula (I):

(I)

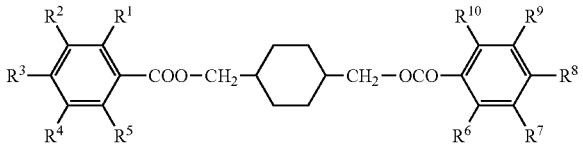

in formula (I), $R^1$ through $R^{10}$ represents independently, a hydrogen atom, a halogen atom, a substituted or unsubstituted alkyl group of carbon number of from 1 to 5, a substituted or unsubstituted aryl group, or a substituted or unsubstituted alkoxy group of carbon number of from 1 to 5.

The cyclohexane dimethanol-diaryl ester compounds that are preferably used in the invention include the cyclohexane dimethanol-diaryl ester compound having a structure represented by the structural formula (I-1):

(I-1)

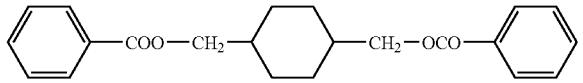

and the cyclohexane dimethanol-diaryl ester compound having a structure represented by the structural formula (I-2):

(I-2)

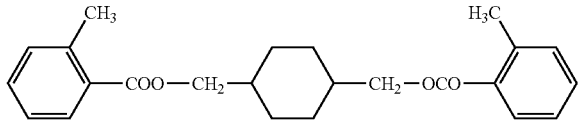

The cyclohexane dimethanol-diaryl ester compound is preferably contained in an amount in the range of 0.1 parts by weight to 30 parts by weight with respect to 100 parts by weight of a resin binder in a layer that contains the cyclohexane dimethanol-diaryl ester compound.

A method of manufacturing the electrophotographic photoconductor according to the invention comprises a step of applying a coating liquid over the conductive substrate to form a layer, wherein the coating liquid contains the cyclohexane dimethanol-diaryl ester compound represented by the formula (I).

The present invention provides an excellent photoconductor by containing the above-specified compound in a layer of the photoconductor. Addition of the above-specified compound in a surface layer improves wear resistance of the photoconductor and suppresses penetration of harmful gases and moisture into the photosensitive layer, irrespective of the properties of other organic materials. In the case of a laminated layer type photoconductor, this compound can be contained in an internal layer of a charge generation layer or an undercoat layer, thereby suppressing influx and release of the harmful gases and moisture into the layers. Therefore, the present invention provides an electrophotographic photoconductor that exhibits stable electric characteristics and image performances without limitation imposed by the types of organic materials used and environmental conditions in operation.

Although an aromatic carboxylate disclosed in Japanese Unexamined Patent Publication No. H1-101543 has a like structure as the compound of formula (I) and used for a photosensitive material in silver halogenide photography, use of such a compound for photosensitive material in electrophotography has not been known.

BRIEF DESCRIPTION OF THE DRAWINGS

FIG. 1(*b*) is a schematic sectional view of an example of an electrophotographic photoconductor of a positive-charging single layer type.

DETAILED DESCRIPTION OF THE INVENTION

In the following paragraphs, some preferred embodiment of an electrophotographic photoconductor according to the invention will be described in detail with reference to the accompanying drawings. The invention, however, shall not be limited to the embodiment examples.

Figure 1:
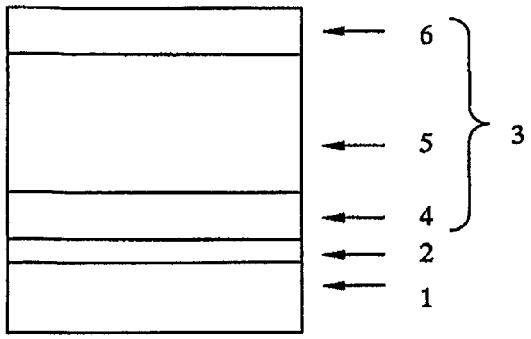
FIG. 1(*a*) is a schematic sectional view of an example of an electrophotographic photoconductor of a negative-charging function-separated laminated-layer type.
Figure 1:
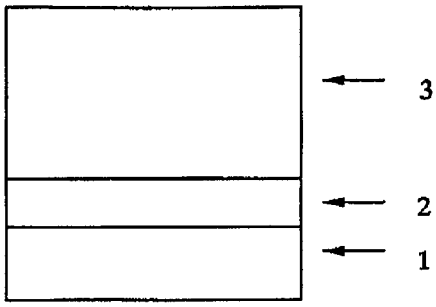

Electrophotographic photoconductors are generally classified into negative-charging laminated layer type photoconductors and positive-charging laminated layer type photoconductors, both of which are function-separated, and single layer type photoconductors, which are mainly positive-charging. The present invention can be applied to every one of these types of photoconductors. FIGS. 1(*a*) and 1(*b*) are schematic sectional views of electrophotographic photoconductors according to embodiment of the invention. FIG. 1(*a*) shows a negative-charging laminated layer type electrophotographic photoconductor, and FIG. 1(*b*) shows a positive-charging single layer type electrophotographic photoconductor.

A negative-charging laminated layer type photoconductor as shown in FIG. 1(*a*) comprises an undercoat layer 2 and a photosensitive layer 3 consisting of a charge generation layer 4 exhibiting charge generation function and a charge transport layer 5 exhibiting charge transport function sequentially laminated on a conductive substrate 1. A surface protection layer 6 is further formed. A positive charging single layer type photoconductor comprises an undercoat layer 2 and a single photosensitive layer 3 exhibiting both charge generation and charge transport functions sequentially laminated on a conductive substrate 1. In both types of photoconductors, the undercoat layer 2 is formed as necessary, and the surface protection layer 6 is provided as desired.

It is essential in the invention that a layer(s) composing the photoconductor contains a cyclohexane dimethanol-diaryl ester compound represented by the formula (I):

(I)

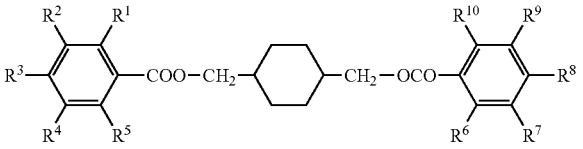

in formula (I), $R^1$ through $R^{10}$ represents independently, a hydrogen atom, a halogen atom, a substituted or unsubstituted alkyl group of carbon number of from 1 to 5, a substituted or unsubstituted aryl group, or a substituted or unsubstituted alkoxy group of carbon number of from 1 to 5. The compound, when contained in a surface protection layer 6 or a charge transport layer 5, which are provided in the surface region of a photoconductor, or in a single layer type photosensitive layer, has an effect to improve wear resistance and an effect to suppress influx and release of harmful gases and moisture in the internal portion of the photosensitive layer. The compound, when contained in an internal layer of charge generation layer 4 or an undercoat layer 2, has an effect to suppress influx and release of harmful gases and moisture in the internal layer. The compound can be contained in plural layers in the photoconductor, which provides a synergetic effect.

The following gives examples of specific structures of the cyclohexane dimethanol-diaryl ester compounds represented by the formula (I). The compounds useful in the invention, however, are not limited to those examples.

(I-1)

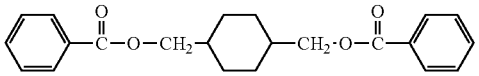

(I-2)

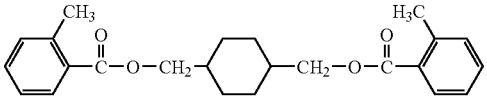

(I-3)

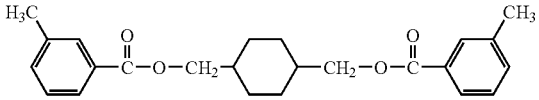

(I-4)

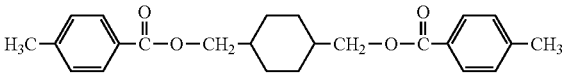

(I-5)

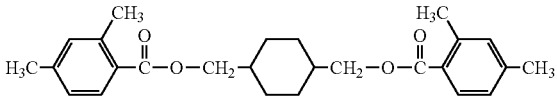

(I-6)

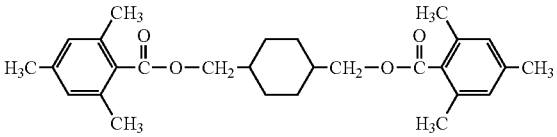

(I-7)

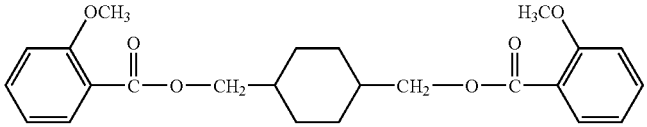

(I-8)

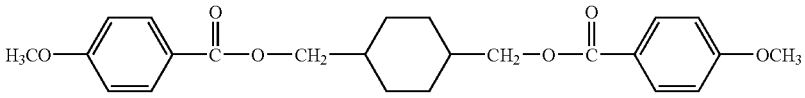

(I-9)

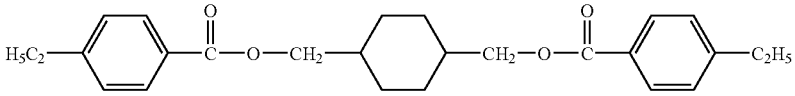

(I-10)

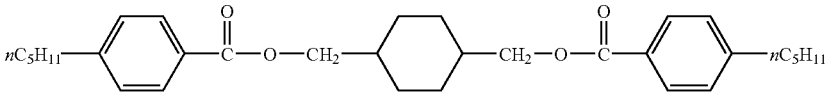

(I-11)

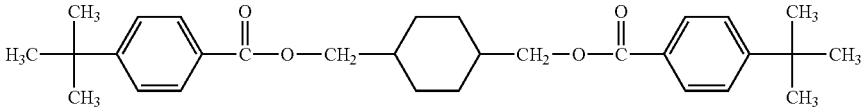

(I-12)

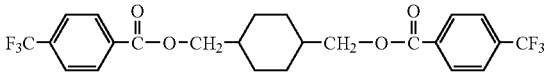

(I-13)

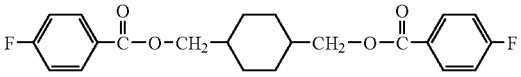

-continued (I-14)

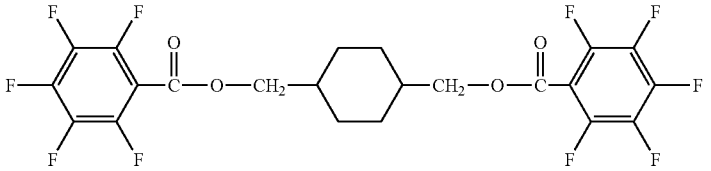

(I-15)

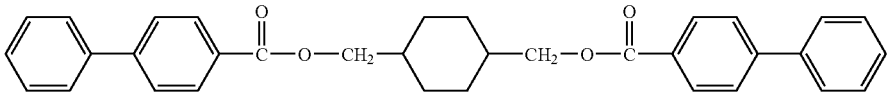

(I-16)

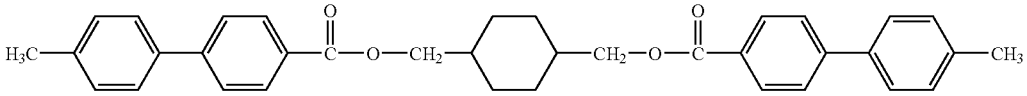

(I-17)

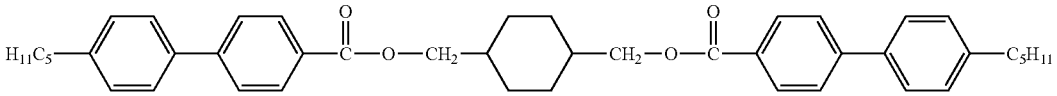

(I-18)

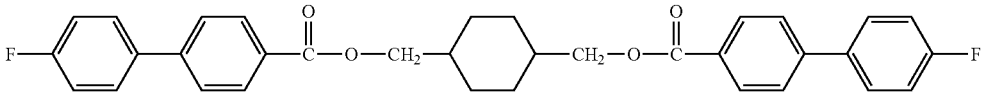

(I-19)

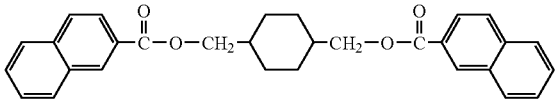

(I-20)

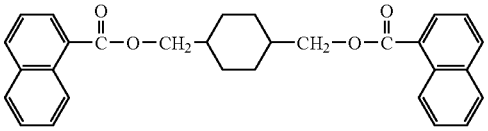

Of the cyclohexane dimethanol-diaryl ester compounds represented by the formula (I), particularly favorable in the invention are compounds in which $R^1$ through $R^{10}$ are independently a hydrogen atom or an unsubstituted alkyl group of carbon number of from 1 to 5. Among them, the compounds represented by the structural formula (I-1) and the structural formula (I-2) are preferable. Amount of contained cyclohexane dimethanol-diaryl ester compound represented by the formula (I) is preferably in the range of 0.1 parts by weight to 30 parts by weight, more preferably in the range of 0.5 parts by weight to 20 parts by weight with respect to 100 parts by weight of a resin binder of the layer to which the compound of formula (I) is added.

An important feature of the invention is that a layer(s) of the photoconductor contains the compound represented by the formula (I). Other features can be constituted according to common methods known in the art. A constitution of a photoconductor according to the invention will be described with reference to an example of a laminated layer type photoconductor as shown in FIG. 1(*a*), although the invention shall not be limited by the description hereinafter.

The conductive substrate 1 works as one electrode of the photoconductor and at the same time, as a support member for other layers composing the photoconductor. The conductive substrate can have a form of a drum, a plate, or a film. Material of the conductive substrate can be selected from metallic materials including aluminum, stainless steel, and nickel, and glass and resin with electric conductivity treatment on the surface.

The undercoat layer 2 can be a layer mainly composed of resin or a metal oxide film such as alumite. The undercoat layer is provided as needed for the purpose of controlling injection performance of charges from the conductive substrate to the photosensitive layer, covering defects on the substrate surface, and improving adhesiveness between the photosensitive layer and a surface under the photosensitive layer. A resin binder useful for the undercoat layer can be selected from insulative polymers including casein, poly(vinyl alcohol), polyamide, melamine, and cellulose, and conductive polymers including polythiophene, polypyrrole, and polyaniline. These materials can be used alone or as a mixture in appropriate combination. The resin binder can contain metal oxides such as titanium dioxide or zinc oxide.

Thickness of the undercoat layer can be set, though depending on the composition, at any value as far as any adverse affect such as increase of residual potential does not occur in repeated operation, and is preferably in the range of 0.01 to 50 μm.

The charge generation layer 4 is formed by applying a coating liquid prepared by dispersing particles of charge generation material in a resin binder. The charge generation layer generates charges upon receipt of light. It is important for the charge generation layer to exhibit good charge injection performance into the charge transport layer 5 as well as high charge generation efficiency, and the charge generation layer is desired to exhibit charge injection with little electric field dependence and good charge injection performance at low electric field. Since the charge generation layer 4 needs only to carry out charge generation function, the thickness thereof is determined by light absorption coefficient of the charge generation material and generally not larger than 1 μm, preferably within 0.5 μm. The charge generation layer is mainly composed of a charge generation material and additionally can contain charge transport material. The amount of the charge generation material is normally in the range of 1 to 100 parts by weight, preferably 5 to 50 parts by weight, with respect to 10 parts by weight of resin binder.

The charge generation material can be selected from phthalocyanine compounds including X-type metal free phthalocyanine, τ-type metal free phthalocyanine, α-type titanylphthalocyanine, β-type titanylphthalocyanine, Y-type titanylphthalocyanine, y-type titanylphthalocyanine, amorphous titanylphthalocyanine, ϵ-type copper phthalocyanine; azo pigments, anthanthrone pigments, thiapyrylium pigments, perylene pigments, perynone pigments, squarilium pigments, and quinacridone pigments. These materials can be used alone or in an appropriate combination. A proper material can be selected corresponding to wavelength region of the exposure light source used for image formation.

A resin binder used in a charge generation layer can be selected from polycarbonate resin, polyester resin, polyamide resin, polyurethane resin, poly(vinyl chloride) resin, vinyl acetate resin, phenoxy resin, poly(vinyl acetal) resin, poly (vinyl butyral) resin, polystyrene resin, polysulfone resin, diallyl phthalate resin, methacrylate resin, and polymers and copolymers of these resins. These materials can also be used in an appropriate combination.

The charge transport layer 5 is primarily composed of charge transport material and resin binder. The charge transport layer holds charges of the photoconductor in the dark as an insulator layer, and transports charges injected from the charge generation layer upon receipt of light. Thickness of the charge transport layer is preferably in the range of 3 to 50 μm for maintaining a practically effective surface potential, and more preferably in the range of 15 to 40 μm.

A charge transport material can be selected from hydrazone compounds, styryl compounds, diamine compounds, butadiene compounds, and indole compounds. These materials can be used alone or in a mixture of appropriate combination. Amount of the charge transport material is normally in the range of 2 to 50 parts by weight, preferably in the range of 3 to 30 parts by weight with respect of 100 parts by weight of resin binder. Specific examples of charge transport materials that can be used in the invention are given in the following.

II-1

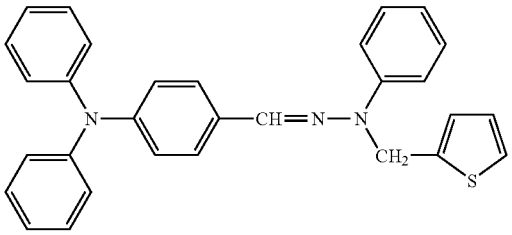

II-2

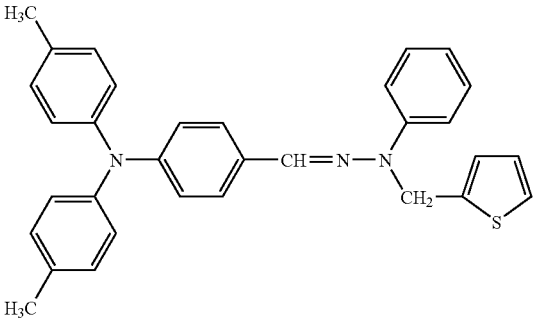

II-3

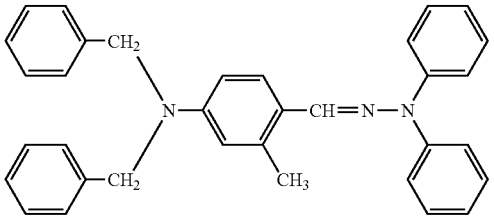

II-4

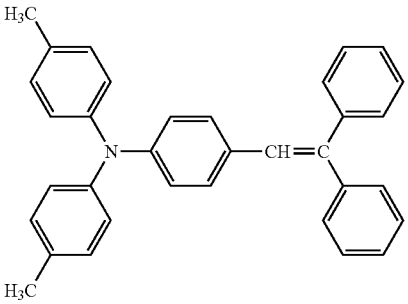

II-5

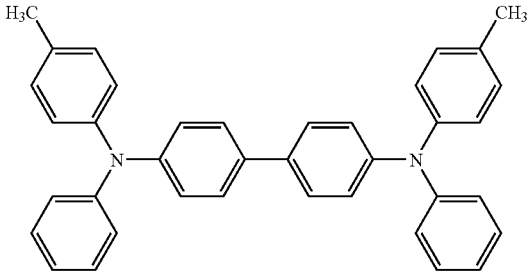

II-6

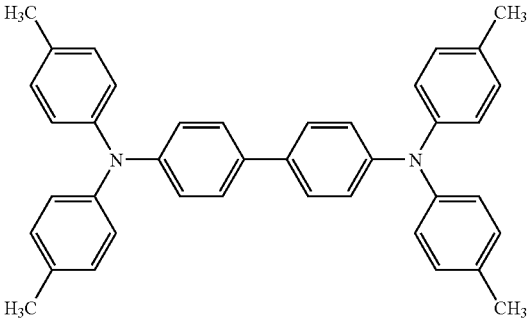

-continued
II-7
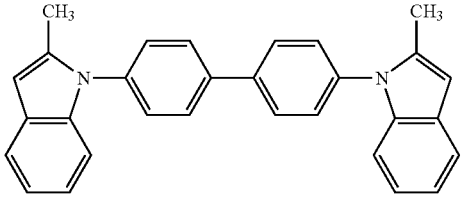
II-8
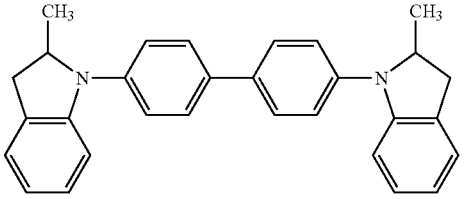
II-9
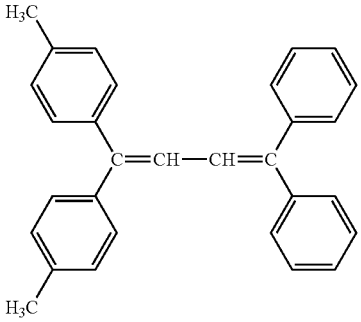
II-10
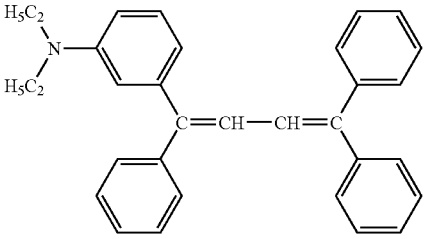
II-11
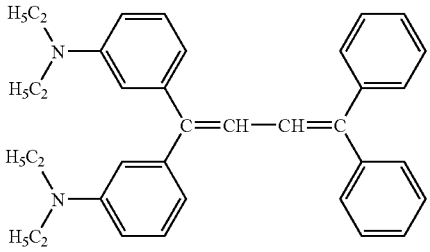
II-12
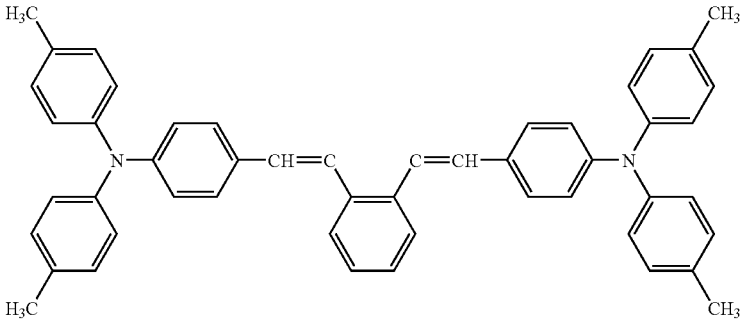
II-13
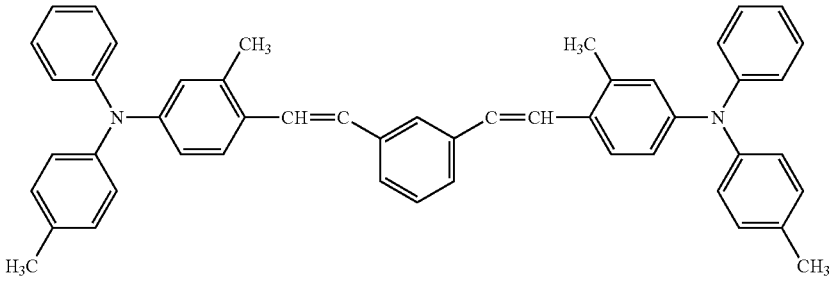

A resin binder for the charge transport layer can be selected from polycarbonate resins including bisphenol A, bisphenol Z, and bisphenol A-bisphenyl copolymer; polystyrene resin, and polyphenylene resin. These materials can be used alone or in a mixture of appropriate combination.

The surface protection layer 6 is provided as necessary on the surface of the photosensitive layer for the purpose of improving durability against environmental conditions and improving mechanical strength. The surface protection layer is composed of a material exhibiting durability against mechanical stress and good durability against environmental conditions. The surface protection layer is desired to transmit light sensed by the charge generation layer with minimal loss. Thickness of the surface protection layer, though depending on the composition of the material, can be determined at any value as far as any adverse affect such as increase of residual potential in repeated continuous operation does not occur.

The surface protection layer 6 can be a layer mainly composed of resin binder or an inorganic layer such as amorphous carbon, for example. The binder resin can be polycarbonate resin. In order to improve electrical conductivity, to reduce friction coefficient, and to give lubricity, the resin binder can contain metal oxide such as silicon oxide (silica), titanium oxide, zinc oxide, calcium oxide, aluminum oxide (alumina), and zirconium oxide; metal sulfate such as valium sulfate and calcium sulfate; metal nitride such as silicon nitride and aluminum nitride; fine particles of metal oxide; particles of fluorine-containing resin such as ethylene tetrafluoride resin; or particles of fluorine-containing comb-type graft polymer resin.

The surface protection layer can further contain: the compound represented by the formula (I) according to the invention; charge transport material or electron accepting material used in the charge transport layer for the purpose of giving charge transport ability; or a leveling agent such as silicone oil or fluorine-containing oil for the purpose of improving leveling property and giving lubricity to the formed film.

A photosensitive layer 3 of a single layer type in a single layer type photoconductor is mainly composed of charge generation material, charge transport material, and resin binder. The charge generation material and the charge transport material can be selected from the materials for the charge generation layer 4 and the charge transport layer 5. The resin binder can also be appropriately selected from the resins for use in those layers. There are two types of charge transport materials: hole transport material and electron transport material. A photosensitive layer 3 of a single layer type preferably includes both types of charge transport material.

Amount of charge generation material contained in the photosensitive layer 3 of a single layer type is normally in the range of 0.01 to 50 wt %, preferably in the range of 0.1 to 20 wt %, more preferably in the range of 0.5 to 10 wt % with respect to solid component of the photosensitive layer. Content of charge transport material is preferably in the range of 10 to 90 wt %, more preferably in the range of 20 to 80 wt % with respect to solid component of the photosensitive layer. Of this charge transport material, the content of electron transport material is preferably in the range of 10 to 60 wt %, more preferably in the range of 15 to 50 wt % with respect to solid component of the photosensitive layer, and the content of hole transport material is preferably in the range of 10 to 60 wt %, more preferably in the range of 20 to 50 wt % with respect to solid component of the photosensitive layer. The content of resin binder is normally in the range of 10 to 90 wt %, preferably in the range of 20 to 80 wt % with respect to solid component of the photosensitive layer.

Thickness of the single layer type photosensitive layer is preferably in the range of 3 to 100 μm, more preferably in the range of 10 to 50 μm for maintaining a practically effective surface potential.

In the invention, various kinds of additives can be contained as desired in the undercoat layer 2, charge generation layer 4, charge transport layer 5, and single layer type photosensitive layer 3 for the purpose of enhancement of sensitivity, reduction of residual potential, improvement in resistance against environment, improvement in stability against harmful light, and improvement in durability including wear resistance. Useful additives include, besides the compound represented by the formula (I) according to the invention, succinic anhydride, maleic anhydride, succinic anhydride dibromide, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, and trinitrofluorenone. Antioxidant and light stabilizer can be added, too. Compounds for these purposes include chromanol derivatives such as tocopherol, ether compound, ester compound, polyarylalkane compound, hydroquinone derivative, diether compound, benzophenone derivative, benzotriazole derivative, thioether compound, phenylenediamine derivative, phosphonic ester, phosphite, phenol compound, hindered phenol compound, straight chain amine compound, cyclic amine compound, and hindered amine compound, but, not limited to these substances.

The photosensitive layer can further contain leveling agent such as silicone oil and fluorine-containing oil for the purpose of improving leveling performance and giving lubricity on the formed film.

Photoconductors of the invention produce the effects as described above in applications to a wide variety of machine processes: electrification processes of contact electrification using a roller and a blush and non-contact electrification using corotron and scorotron, and development processes of contact development and non-contact development using nonmagnetic-one component, magnetic one component, and two components. The invention is advantageous in all these processes.

A photoconductor of the invention can be manufactured by carrying out a step of applying a coating liquid over a conductive substrate by means of a common method to form a target layer, the coating liquid containing a cyclohexane dimethanol-diaryl ester compound represented by the formula (I). The coating liquid can be applied by a variety of techniques including dip coating and spray coating, without limiting to any special application method.

The invention will be described in more detail with reference to specific examples.

SYNTHESIS EXAMPLE

In a three neck flask with a volume of 500 ml, 11.5 g of 1,4-cyclohexane dimethanol (manufactured by Wako Pure Chemical Industries Co., Ltd.) and 15.8 g of pyridine (manufactured by Wako Pure Chemical Industries Co., Ltd.) were dissolved in 150 ml of dichloroethane, and 22.5 g of benzoyl chloride (manufactured by Wako Pure Chemical Industries Co., Ltd.) was dropped through a funnel at room temperature. After dropping, the liquid was stirred at 50° C. for 4 hr, and then cooled down to room temperature. The reacted liquid was washed with 300 ml of ion exchange water three times. The dichloroethane solution was condensed under reduced pressure, and toluene was added to the residue for crystallization. Thus, 21.2 g of an end substance, the compound represented by the formula (I-1) (having a melting point of 94° C.), was obtained.

Figure 2:
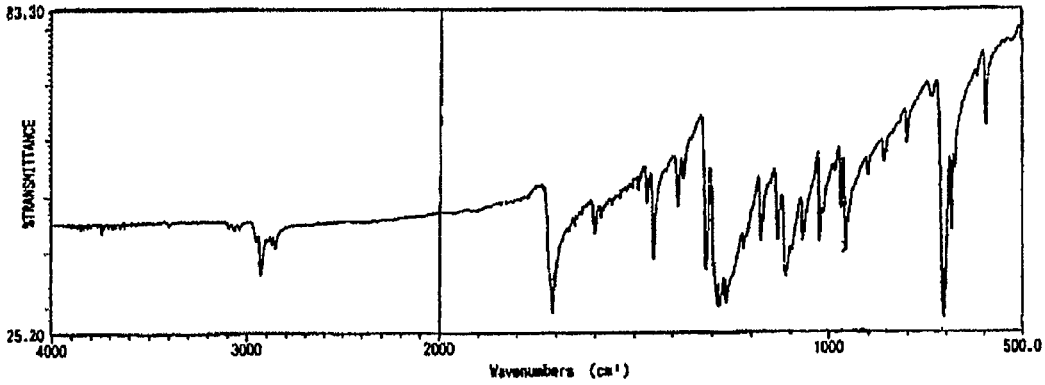
FIG. 2 is a chart of infrared spectrum of the compound represented by the structural formula (I-1).

On the obtained compound, confirmation of structure was conducted by means of NMR spectroscopy, mass spectroscopy, and infrared spectroscopy. FIG. 2 shows an example of infrared spectroscopy chart of the compound. Negative-charging laminated layer type electrophotographic photoconductor Example 1

A coating liquid for an undercoat layer was prepared by dissolving and dispersing 5 parts by weight of alcohol-soluble nylon (Amilan CM8000, a product of Toray Industries, Inc.) and 5 parts by weight of fine particles of aminosilane-treated titanium oxide in 90 parts by weight of methanol. A conductive substrate of aluminum drum was dipped in this liquid and drew up to form a coating film on outer surface of the substrate. The substrate was dried at 100° C. for 30 min to form an undercoat layer 2 μm thick.

A coating liquid for forming a charge generation layer was prepared by dispersing 15 parts by weight of a charge generation material of Y-type titanylphthalocyanine disclosed in Japanese Unexamined Patent Application Publication No. S64-17066 and 15 parts by weight of a resin binder of poly (vinyl butyral) (S-LEC B BX-1, a product of Sekisui Chemical Co., Ltd.) in 600 parts by weight of an equal quantity mixture of dichloromethane and dichloroethane using a sand mill dispersing machine for 1 hr. The coating liquid was applied on the undercoat layer by dip-coating. The substrate was dried at 80° C. for 30 min to form a charge generation layer 0.3 μm thick.

A coating liquid for forming a charge transport layer was prepared by dissolving 100 parts by weight of a charge transport material of the compound represented by the structural formula (II-1) and 100 parts by weight of a resin binder of polycarbonate resin (Panlite TS-2050, a product of Teijin Chemicals Ltd.) in 900 parts by weight of dichloromethane, and adding 0.1 parts by weight of silicone oil (KP-340, a product of Shin-Etsu Polymer Co., Ltd.) and 10 parts by weight of the compound represented by the structural formula (I-1). The coating liquid was applied on the charge generation. layer. The substrate was dried at 90° C. for 60 min to form a charge transport layer 25 μm thick. Thus, an electrophotographic photoconductor was manufactured.

Example 2

An electrophotographic photoconductor was manufactured in the same manner as in Example 1 except that the compound represented by the structural formula (I-1) was replaced by the compound represented by the structural formula (I-2).

Example 3

An electrophotographic photoconductor was manufactured in the same manner as in Example 1 except that the compound represented by the structural formula (I-1) was replaced by the compound represented by the structural formula (I-4).

Example 4

An electrophotographic photoconductor was manufactured in the same manner as in Example 1 except that the charge transport material was changed from the compound represented by the structural formula (II-1) to the compound represented by the structural formula (II-6).

Example 5

An electrophotographic photoconductor was manufactured in the same manner as in Example 1 except that 1.0 part by weight of the compound represented by the structural formula (I-1) was added into the coating liquid for forming a charge generation layer as used in Example 1.

Example 6

An electrophotographic photoconductor was manufactured in the same manner as in Example 1 except that 1.0 part by weight of the compound represented by the structural formula (I-1) was added into the coating liquid for forming a charge generation layer as used in Example 1, and the compound represented by the structural formula (I-1) was not added into the coating liquid for forming a charge transport layer.

Example 7

An electrophotographic photoconductor was manufactured in the same manner as in Example 1 except that 3.0 parts by weight of the compound represented by the structural formula (I-1) was added into the coating liquid for forming an undercoat layer as used in Example 1.

Example 8

An electrophotographic photoconductor was manufactured in the same manner as in Example 1 except that 3.0 parts by weight of the compound represented by the structural formula (I-1) was added into the coating liquid for forming an undercoat layer as used in Example 1 and the compound represented by the structural formula (I-1) was not added into the coating liquid for forming a charge transport layer.

Example 9

An electrophotographic photoconductor was manufactured in the same manner as in Example 1 except that 3.0 parts by weight of the compound represented by the structural formula (I-1) was added into the coating liquid for forming an undercoat layer as used in Example 1 and 1.0 part by weight of the compound represented by the structural formula (I-1) was added into the coating liquid for forming a charge generation layer as used in Example 1.

Example 10

After forming an undercoat layer and a charge generation layer on a conductive substrate in the same manner as in Example 1, a charge transport layer was formed in the same manner as in Example 1 except that the compound represented by the structural formula (I-1) and the silicone oil were not added into the coating liquid for forming the charge transport layer and the thickness of the charge transport layer was 20 μm. After that, a coating liquid for forming a surface protection layer was applied on the charge transport layer. The coating liquid for the surface protection layer was prepared by dissolving 80 parts by weight of a charge transport material of the compound represented by the structural formula (II-1) and 120 parts by weight of a resin binder of polycarbonate resin (Toughzet B-500, a product of Idemitsu Kosan Co., Ltd.) in 900 parts by weight of dichloromethane, and adding 0.1 parts by weight of silicone oil (KP-340, a product of Shin-Etsu Polymer Co., Ltd.) and 12 parts by weight of the compound represented by the formula (I-1). The substrate was dried at 90° C. for 60 min to form a surface protection layer 10 μm thick. Thus, an electrophotographic photoconductor was manufactured.

Example 11

An undercoat layer and a charge generation layer were formed in the same manner as in Example 1 except that 3.0 parts by weight of the compound represented by the structural formula (I-1) was added in the coating liquid for the undercoat layer as used in Example 1 and 1.0 part by weight of the compound represented by the structural formula (I-1) was added in the coating liquid for forming the charge generation layer as used in Example 1. A charge transport layer was formed in the same manner as in Example 1 except that the compound represented by the structural formula (I-1) and the silicone oil were not added into the coating liquid for forming the charge transport layer and the thickness of the charge transport layer was 20 μm. After that, a coating liquid for forming a surface protection layer was applied on the charge transport layer. The coating liquid for the surface protection layer was prepared by dissolving 80 parts by weight of a charge transport material of the compound represented by the structural formula (II-1) and 120 parts by weight of a resin binder of polycarbonate resin (Toughzet B-500, a product of Idemitsu Kosan Co., Ltd.) in 900 parts by weight of dichloromethane, and adding 0.1 parts by weight of silicone oil (KP-340, a product of Shin-Etsu Polymer Co., Ltd.) and 12 parts by weight of the compound represented by the formula (I-1). The substrate was dried at 90° C. for 60 min to form a surface protection layer 10 μm thick. Thus, an electrophotographic photoconductor was manufactured.

Example 12

An electrophotographic photoconductor was manufactured in the same manner as in Example 1 except that the Y-type titanylphthalocyanine was replaced by α-type titanylphthalocyanine disclosed in Japanese Unexamined Patent Application Publication No. S61-217050.

Example 13

An electrophotographic photoconductor was manufactured in the same manner as in Example 1 except that the Y-type titanylphthalocyanine was replaced by α-type metal free phthalocyanine (Fastogen Blue 8120B, a product of Dainippon Ink and Chemicals, Inc.).

Comparative Example 1

An electrophotographic photoconductor was manufactured in the same manner as in Example 1 except that the compound represented by the structural formula (I-1) was not used.

Comparative Example 2

An electrophotographic photoconductor was manufactured in the same manner as in Example 1 except that the compound represented by the structural formula (I-1) was not used but a quantity of the resin binder used in the charge transport layer was increased to 110 parts by weight.

Comparative Example 3

An electrophotographic photoconductor was manufactured in the same manner as in Example 1 except that the compound represented by the structural formula (I-1) was not used but 10 parts by weight of dioctyl phthalate (melting point of −50° C., a product of Wako Pure Chemical Industries Co., Ltd.) was added in the coating liquid for forming the charge transport layer.

Comparative Example 4

An electrophotographic photoconductor was manufactured in the same manner as in Example 12 except that the compound represented by the structural formula (I-1) was not used.

Comparative Example 5

An electrophotographic photoconductor was manufactured in the same manner as in Example 13 except that the compound represented by the structural formula (I-1) was not used.

Electrophotographic performances were evaluated on the photoconductors manufactured in Examples 1 through 13 and Comparative Examples 1 through 5 by the following method. After the surface of the photoconductor was charged to −650 V in the dark by corona discharge in an evaluation apparatus, the surface potential V0 was measured immediately after the electrification. After leaving the photoconductor in the dark for 5 seconds, the surface potential V5 was measured to obtain a potential retention rate Vk5 (%) at 5 sec after electrification defined by the formula (1):

$$Vk5(\%)=V5/V0\times 100 \qquad \text{formula (1)}$$

Then, the photoconductor was illuminated by exposure light from a light source of halogen lamp spectrally focused at 780 nm using a filter for 5 sec from the time of surface potential at −600 V. The values of E1/2 and E50 were obtained, in which E1/2 (μJ $cm^{-2}$) is the amount of exposure light illuminated until the surface potential decayed to −300 V, and E50 (μJ $cm^{-2}$) is the amount of exposure light illuminated until the surface potential decayed to −50 V.

Each of the photoconductors of Examples and Comparative Examples was placed in an ozone atmosphere in an ozone exposure apparatus. After exposing to ozone with a concentration of 100 ppm for 2 hr, the potential retention rate was measured and obtained a rate of change of the potential retention rate Vk5 before and after the ozone exposure, to determine a rate of change of retention rate in ozone exposure ΔVk5. More specifically, a rate of change of retention rate in ozone exposure ΔVk5 is defined by the formula (2):

$$\Delta Vk5(\%)=VK5_2(\text{after ozone exposure})/Vk5_1(\text{before ozone exposure})\times 100 \qquad \text{formula (2),}$$

where $Vk5_1$ is a retention rate before ozone exposure and $VK5_2$ is a retention rate after ozone exposure.

Materials and amount of the additives in the photoconductors of Examples and Comparative Examples are summarized in Table 1. The amounts in the Table 1 are in "parts by weight". Table 2 shows the electrical characteristics measured on the photoconductors as described above.

TABLE 1

| | | charge generation material (*1) | additive material: undercoat layer material | undercoat layer amount | charge generation layer material | charge generation layer amount | charge transport layer material | charge transport layer amount | surface protection layer material | surface protection layer amount | charge transport material |
|---|---|---|---|---|---|---|---|---|---|---|---|
| Examples | 1 | Y-TiOPc | — | — | — | — | (I-1) | 10 | — | — | (II-1) |
| | 2 | Y-TiOPc | — | — | — | — | (I-2) | 10 | — | — | (II-1) |
| | 3 | Y-TiOPc | — | — | — | — | (I-4) | 10 | — | — | (II-1) |
| | 4 | Y-TiOPc | — | — | — | — | (I-1) | 10 | — | — | (II-6) |
| | 5 | Y-TiOPc | — | — | (I-1) | 1 | (I-1) | 10 | — | — | (II-1) |
| | 6 | Y-TiOPc | — | — | (I-1) | 1 | — | — | — | — | (II-1) |
| | 7 | Y-TiOPc | (I-1) | 3 | — | — | (I-1) | 10 | — | — | (II-1) |
| | 8 | Y-TiOPc | (I-1) | 3 | — | — | — | — | — | — | (II-1) |
| | 9 | Y-TiOPc | (I-1) | 3 | (I-1) | 1 | (I-1) | 10 | — | — | (II-1) |
| | 10 | Y-TiOPc | — | — | — | — | — | — | (I-1) | 12 | (II-1) |
| | 11 | Y-TiOPc | (I-1) | 3 | (I-1) | 1 | — | — | (I-1) | 12 | (II-1) |
| | 12 | α-TiOPc | — | — | — | — | (I-1) | 10 | — | — | (II-1) |
| | 13 | X-$H_2$Pc | — | — | — | — | (I-1) | 10 | — | — | (II-1) |
| Comparative Examples | 1 | Y-TiOPc | — | — | — | — | — | — | — | — | (II-1) |
| | 2 | Y-TiOPc | — | — | — | — | — | — | — | — | (II-1) |
| | 3 | Y-TiOPc | — | — | — | — | dioctyl phthalate | 10 | — | — | (II-1) |
| | 4 | α-TiOPc | — | — | — | — | — | — | — | — | (II-1) |
| | 5 | X-$H_2$Pc | — | — | — | — | — | — | — | — | (II-1) |

(*1) Y-TiOPc: Y-type titanylphthalocyanine, α-TiOPc: α-type titanylphthalocyanine, X-$H_2$Pc: X-type metal free phthalocyanine

TABLE 2

| | Vk5 (%) | E½ (μJ/cm²) | E50 (μJ/cm²) | change of retention rate in ozone exposure ΔVk5 (%) |
|---|---|---|---|---|
| Example 1 | 93.8 | 0.14 | 1.08 | 96.5 |
| Example 2 | 93.5 | 0.12 | 1.01 | 97.2 |
| Example 3 | 95.0 | 0.15 | 1.10 | 97.1 |
| Example 4 | 94.3 | 0.18 | 1.11 | 98.2 |
| Example 5 | 93.6 | 0.16 | 1.16 | 98.5 |
| Example 6 | 94.5 | 0.13 | 0.99 | 98.8 |
| Example 7 | 94.8 | 0.16 | 1.25 | 96.3 |
| Example 8 | 95.0 | 0.14 | 1.01 | 96.1 |
| Example 9 | 94.6 | 0.14 | 1.03 | 96.8 |
| Example 10 | 94.4 | 0.16 | 1.49 | 96.4 |
| Example 11 | 95.0 | 0.17 | 1.67 | 97.8 |
| Example 12 | 94.6 | 0.31 | 2.06 | 96.8 |
| Example 13 | 94.4 | 0.36 | 2.81 | 96.4 |
| Comparative Example 1 | 95.0 | 0.15 | 1.10 | 79.8 |
| Comparative Example 2 | 94.8 | 0.21 | 1.21 | 78.8 |
| Comparative Example 3 | 96.3 | 0.31 | 2.00 | 82.0 |
| Comparative Example 4 | 95.0 | 0.36 | 2.89 | 81.1 |
| Comparative Example 5 | 95.0 | 0.36 | 2.89 | 81.1 |

The above results have confirmed that the use of the compound represented by the formula (I) added in a layer(s) of the photoconductor according to the invention suppresses change of potential retention rate before and after ozone exposure without any significant influence on the initial electrical characteristics.

Comparative Example 2, in which the compound according to the invention was not added but the binder resin for the charge transport layer was increased, resulted in a decreased sensitivity and a large change of retention rate before and after ozone exposure. This result has revealed that the effect achieved by use of the compound according to the invention cannot be obtained by simply increasing the amount of binder resin for the charge transport layer.

Change of the type of phthalocyanine used for the charge generation material scarcely varied the initial sensitivity due to the use of the additive and suppressed change of retention rate before and after ozone exposure.

Next, the photoconductors manufactured in Examples and Comparative Examples were mounted on a digital copier of magnetic two component development system that was modified so as to measure surface potential of a photoconductor. Before and after 100 thousand sheets of printings on a practical printer, evaluations were conducted on the stability of electrical potential (bright potential), image memories, and the amount of wear of the photosensitive layer due to friction with paper and a blade.

The evaluation of image memories was carried out, on printed image sample with a checker flag pattern in the first half portion of the scanning and a half tone figure in the second half portion of the scanning, by reading out memory phenomena showing the checker flag pattern in the half tone portion. The case in which no memory was observed is marked by ○, the case in which memories were observed a little is marked by Δ, and the case in which memories were observed significantly is marked by X. The case in which the light and shade of image were similar to the original is labeled as "positive", and the case in which the light and shade of image were reversed is labeled as "negative". The results of the image memory evaluation are given in Table 3.

TABLE 3

| | | initial bright potential (−V) | bright potential after printings (*1) (−V) | change of bright potential after printings (*1) (−V) | initial image memories | image memories after printings (*1) | amount of worn photosensitive layer after printings (*1) (μm) |
|---|---|---|---|---|---|---|---|
| Examples | 1 | 117 | 124 | 7 | ○ | ○ | 0.21 |
| | 2 | 124 | 133 | 9 | ○ | ○ | 0.22 |
| | 3 | 113 | 119 | 6 | ○ | ○ | 0.21 |

TABLE 3-continued

| | | initial bright potential (−V) | bright potential after printings (*1) (−V) | change of bright potential after printings (*1) (−V) | initial image memories | image memories after printings (*1) | amount of worn photosensitive layer after printings (*1) (μm) |
|---|---|---|---|---|---|---|---|
| | 4 | 118 | 123 | 5 | ○ | ○ | 0.21 |
| | 5 | 134 | 138 | 4 | ○ | ○ | 0.23 |
| | 6 | 140 | 144 | 4 | ○ | ○ | 0.21 |
| | 7 | 118 | 122 | 4 | ○ | ○ | 0.19 |
| | 8 | 125 | 130 | 5 | ○ | ○ | 0.18 |
| | 9 | 126 | 130 | 4 | ○ | ○ | 0.22 |
| | 10 | 135 | 140 | 5 | ○ | ○ | 0.21 |
| | 11 | 139 | 143 | 4 | ○ | ○ | 0.19 |
| | 12 | 221 | 225 | 4 | ○ | ○ | 0.22 |
| | 13 | 304 | 309 | 5 | ○ | ○ | 0.21 |
| Comparative Examples | 1 | 128 | 136 | 8 | ○ | ○ | 0.33 |
| | 2 | 128 | 136 | 8 | ○ | ○ | 0.33 |
| | 3 | 122 | 129 | 7 | ○ | ○ | 0.35 |
| | 4 | 221 | 227 | 6 | ○ | ○ | 0.33 |
| | 5 | 291 | 299 | 8 | ○ | ○ | 0.32 |

(*1) After 100,000 sheets of printings

Table 3 shows that the initial electric characteristics are nearly equivalent between the cases with and without additive of the compound in a layer(s) of a photoconductor according to the invention. It has been further clarified that the addition of the compound decreases amount of wear after 100 thousand sheets of printings by more than 30%. No problem was found in the evaluations on the potential and images after the printings.

Characteristic of electric potential (bright potential) on the photoconductors was studied in environments of from low temperature and low humidity to high temperature and high humidity using the digital copier. Evaluation of images (evaluation of memories) was conducted similarly to the above described way. The results are shown in Table 4.

The results of Table 4 have demonstrated that the use of the compound of the invention decreases the influence of environment on electric potential and image performance, and remarkably improves memories at low temperature and low humidity, in particular.

The photoconductors manufactured in Examples and Comparative Examples were mounted on a facsimile machine of nonmagnetic one component development system that was modified so as to measure surface potential of a photoconductor. Evaluations were conducted on stability of electrical potential (bright potential) and image memories in varied environments of operation of the facsimile machine. The results are given in Table 5.

TABLE 4

| | | low temperature, low humidity (*1) (−V) | normal temperature, normal humidity (*2) (−V) | high temperature, high humidity (*3) (−V) | residual potential change (*4) (−V) | memories at high temperature, high humidity | memories at low temperature, low humidity |
|---|---|---|---|---|---|---|---|
| Examples | 1 | 133 | 117 | 56 | 77 | ○ | ○ |
| | 2 | 151 | 124 | 70 | 81 | ○ | ○ |
| | 3 | 144 | 113 | 50 | 94 | ○ | ○ |
| | 4 | 138 | 118 | 55 | 83 | ○ | ○ |
| | 5 | 146 | 134 | 61 | 85 | ○ | ○ |
| | 6 | 150 | 140 | 62 | 88 | ○ | ○ |
| | 7 | 158 | 118 | 68 | 90 | ○ | ○ |
| | 8 | 161 | 125 | 73 | 88 | ○ | ○ |
| | 9 | 159 | 126 | 74 | 85 | ○ | ○ |
| | 10 | 155 | 135 | 79 | 76 | ○ | ○ |
| | 11 | 162 | 139 | 80 | 82 | ○ | ○ |
| | 12 | 199 | 221 | 118 | 81 | ○ | ○ |
| | 13 | 225 | 304 | 132 | 93 | ○ | ○ |
| Comparative Examples | 1 | 160 | 128 | 58 | 102 | ○ | ○ |
| | 2 | 166 | 128 | 55 | 111 | Δ (positive) | X (negative) |
| | 3 | 236 | 122 | 95 | 141 | Δ (positive) | X (negative) |
| | 4 | 264 | 221 | 133 | 131 | Δ (positive) | X (negative) |
| | 5 | 318 | 291 | 177 | 141 | Δ (positive) | X (negative) |

(*1) temperature 5° C., relative humidity 10%
(*2) temperature 25° C., relative humidity 50%
(*3) temperature 35° C., relative humidity 85%
(*4) residual potential change from low temperature and low humidity to high temperature and high humidity

TABLE 5

| | | low temperature, low humidity (*1) (−V) | normal temperature, normal humidity (*2) (−V) | high temperature, high humidity (*3) (−V) | residual potential change (*4) (−V) | memories at high temperature, high humidity | memories at low temperature, low humidity |
|---|---|---|---|---|---|---|---|
| Examples | 1 | 185 | 121 | 70 | 115 | ○ | ○ |
| | 2 | 174 | 126 | 68 | 106 | ○ | ○ |
| | 3 | 169 | 132 | 69 | 100 | ○ | ○ |
| | 4 | 181 | 134 | 66 | 115 | ○ | ○ |
| | 5 | 177 | 137 | 71 | 106 | ○ | ○ |
| | 6 | 166 | 132 | 74 | 92 | ○ | ○ |
| | 7 | 178 | 127 | 72 | 106 | ○ | ○ |
| | 8 | 169 | 126 | 69 | 100 | ○ | ○ |
| | 9 | 178 | 130 | 77 | 101 | ○ | ○ |
| | 10 | 170 | 133 | 80 | 90 | ○ | ○ |
| | 11 | 172 | 131 | 79 | 93 | ○ | ○ |
| | 12 | 222 | 167 | 102 | 120 | ○ | ○ |
| | 13 | 255 | 189 | 130 | 125 | ○ | ○ |
| Comparative Examples | 1 | 201 | 120 | 59 | 142 | ○ | ○ |
| | 2 | 220 | 117 | 55 | 165 | Δ (positive) | X (negative) |
| | 3 | 237 | 130 | 62 | 175 | Δ (positive) | X (negative) |
| | 4 | 263 | 141 | 66 | 197 | Δ (positive) | X (negative) |
| | 5 | 263 | 141 | 66 | 197 | Δ (positive) | X (negative) |

(*1) temperature 5° C., relative humidity 10%
(*2) temperature 25° C., relative humidity 50%
(*3) temperature 35° C., relative humidity 85%
(*4) residual potential change from low temperature and low humidity to high temperature and high humidity The results of Table 5 have demonstrated that the use of the compound of the invention provides negative-charging laminated layer type electrophotographic photoconductors in which variation of the influence of environment is suppressed in electrophotographic apparatuses in different development systems.

Positive-Charging Single Layer Type Electrophotographic Photoconductor

Example 14

A coating liquid for an undercoat layer was prepared by dissolving and dispersing 5 parts by weight of alcohol-soluble nylon (Amilan CM8000, a product of Toray Industries, Inc.) and 5 parts by weight of fine particles of aminosilane-treated titanium oxide in 90 parts by weight of methanol. A conductive substrate of aluminum drum was dipped in this liquid and drew up to form a coating film on outer surface of the substrate. The substrate was dried at 100° C. for 30 min to form an undercoat layer 2 μm thick.

A coating liquid for forming a single layer type photosensitive layer was prepared by dissolving 7.0 parts by weight of hole transport material of a styryl compound represented by the structural formula (II-12), 3 parts by weight of electron transport material of the compound represented by the structural formula (III) below, (III)

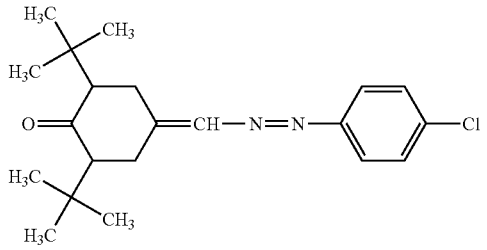

9.6 parts by weight of a resin binder of polycarbonate resin (Panlite TS-2050, a product of Teijin Chemicals Ltd.), 0.04 parts by weight of silicone oil (KF-54, a product of Shin-Etsu Polymer Co., Ltd.), and 1.5 parts by weight of the compound represented by the structural formula (I-1) in 100 parts by weight of methylene chloride, and then adding 0.3 parts by weight of a charge generation material of X-type metal free phthalocyanine disclosed in Japanese Unexamined Patent Application Publication No. 2001-228637, followed by dispersion treatment by means of a sand grind mill. This coating liquid was applied on the undercoat layer and the substrate was dried at the temperature of 100° C. for 60 min to form a single layer type photosensitive layer 25 μm thick. Thus, a positive-charging single layer type electrophotographic photoconductor was manufactured.

Example 15

An electrophotographic photoconductor was manufactured in the same manner as in Example 14 except that the compound represented by the structural formula (I-1) was replaced by the compound represented by the structural formula (I-2).

Example 16

An electrophotographic photoconductor was manufactured in the same manner as in Example 14 except that the compound represented by the structural formula (I-1) was replaced by the compound represented by the structural formula (I-4).

Comparative Example 6

An electrophotographic photoconductor was manufactured in the same manner as in Example 14 except that the compound represented by the structural formula (I-1) was not used.

Comparative Example 7

An electrophotographic photoconductor was manufactured in the same manner as in Example 14 except that the compound represented by the structural formula (I-1) was replaced by dioctyl phthalate (melting point of −50° C., a product of Wako Pure Chemical Industries Co., Ltd.).

Electrophotographic performances were evaluated on the photoconductors manufactured in Examples 14 through 16 and Comparative Examples 6 and 7 by the following method. After the surface of the photoconductor was charged to +650 V in the dark by corona discharge in an evaluation apparatus, the surface potential V0 was measured immediately after the electrification. After leaving the photoconductor in the dark for 5 seconds, the surface potential V5 was measured to obtain a potential retention rate Vk5 (%) at 5 sec after electrification defined by the formula (1) mentioned earlier.

Then, the photoconductor was illuminated by exposure light from a light source of halogen lamp spectrally focused at 780 nm using a filter for 5 sec from the time of surface potential at +600 V. The values of E1/2 and E50 were obtained, in which E1/2 ($\mu J\ cm^{-2}$) is the amount of exposure light illuminated until the surface potential decayed to +300 V, and E50 ($\mu J\ cm^{-2}$) is the amount of exposure light illuminated until the surface potential decayed to +50 V.

Each of the photoconductors of Examples and Comparative Examples was placed in an ozone atmosphere in an ozone exposure apparatus. After exposing to ozone with a concentration of 100 ppm for 2 hr, the potential retention rate was measured, and a rate of change of the potential retention rate Vk5 before and after the ozone exposure was obtained to determine a rate of change of retention rate in ozone exposure ΔVk5. More specifically, a rate of change of retention rate in ozone exposure ΔVk5 is defined by the formula (2) mentioned earlier, where $Vk5_1$ is a retention rate before ozone exposure and $VK5_2$ is a retention rate after ozone exposure.

Materials and amount of the additives in the photoconductors of Examples and Comparative Examples are summarized in Table 6. Table 6 also shows the electrical characteristics measured on the photoconductors. The amounts in the Table 6 are in "parts by weight".

TABLE 6

| | charge generation material | additive material single layer photo-sensitive layer | | hole transport | electron transport | Vk5 | E½ | E50 | change of retention rate |
|---|---|---|---|---|---|---|---|---|---|
| | (*1) | material | amount | material | material | (%) | ($\mu J/cm^2$) | ($\mu J/cm^2$) | ΔVk5 (%) (*2) |
| Example 14 | X-$H_2$Pc | (I-1) | 1.5 | (II-12) | (III) | 85.7 | 0.48 | 2.52 | 93.5 |
| Example 15 | X-$H_2$Pc | (I-2) | 1.5 | (II-12) | (III) | 86.3 | 0.47 | 2.66 | 94.3 |
| Example 16 | X-$H_2$Pc | (I-4) | 1.5 | (II-12) | (III) | 85.9 | 0.48 | 2.59 | 95.5 |
| Comparative Example 6 | X-$H_2$Pc | — | — | (II-12) | (III) | 85.8 | 0.47 | 2.54 | 75.8 |
| Comparative Example 7 | X-$H_2$Pc | dioctyl phthalate | 1.5 | (II-12) | (III) | 84.8 | 0.55 | 2.87 | 78.3 |

(*1) X-$H_2$Pc: X-type metal free phthalocyanine
(*2) change of retention rate after and before ozone exposure The above results have confirmed that the use of the compound represented by the formula (I) added in a single layer type photosensitive layer according to the invention suppresses change of potential retention rate before and after ozone exposure without any significant influence on the initial electrical characteristics.

As described thus far, an electrophotographic photoconductor according to the invention has satisfactory effects in any electrification process and development process, and in both negative-charging and positive-charging processes on the photoconductor. Therefore, an electrophotographic photoconductor according to the invention, which contains an additive of the specific compound in a layer(s) thereof, exhibits stable electrical performances in initial and after repeated operation and in various conditions of operation environment, and hinders generation of image defects such as image memories in any conditions.

The invention claimed is:

1. An electrophotographic photoconductor comprising at least a photosensitive layer formed over a conductive substrate, wherein the photosensitive layer contains a cyclohexane dimethanol-diaryl ester compound represented by the formula (I):

(I)

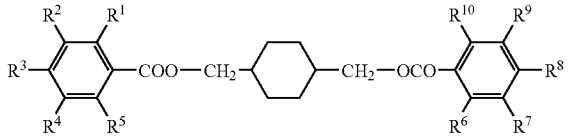

in formula (I), each of $R^1$ through $R^{10}$ represents, independently, a hydrogen atom, a halogen atom, a substituted or unsubstituted alkyl group of carbon number of from 1 to 5, a substituted or unsubstituted aryl group, or a substituted or unsubstituted alkoxy group of carbon number of from 1 to 5.

2. The electrophotographic photoconductor according to claim 1, wherein the photosensitive layer is of a laminated layer type including a charge generation layer and a charge transport layer, the charge generation layer containing the cyclohexane dimethanol-diaryl ester compound.

3. The electrophotographic photoconductor according to claim 1, wherein the photosensitive layer is of a laminated layer type including a charge generation layer and a charge transport layer, the charge transport layer containing the cyclohexane dimethanol-diaryl ester compound.

4. The electrophotographic photoconductor according to claim 1, wherein the photosensitive layer is of a single layer type composed of a single layer, the single layer type photosensitive layer containing the cyclohexane dimethanol-diaryl ester compound.

5. The electrophotographic photoconductor according to claim 1, wherein the cyclohexane dimethanol-diaryl ester compound has a structure represented by the structural formula (I-2):

(I-1)

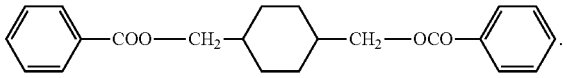

6. The electrophotographic photoconductor according to claim 1, wherein the cyclohexane dimethanol-diaryl ester compound has a structure represented by the structural formula (I-2):

(I-2)

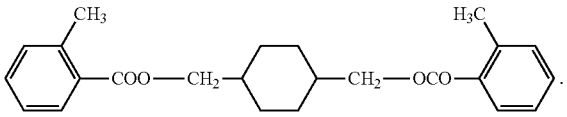

7. The electrophotographic photoconductor according to claim 1, wherein the cyclohexane dimethanol-diaryl ester compound is contained in an amount in the range of 0.1 parts by weight to 30 parts by weight with respect to 100 parts by weight of a resin binder in a layer that contains the cyclohexane dimethanol-diaryl ester compound.

8. A method of manufacturing the electrophotographic photoconductor according to claim 1, the method comprising a step of applying a coating liquid over the conductive substrate to form a layer, wherein the coating liquid contains the cyclohexane dimethanol-diaryl ester compound represented by the formula (I-1).

9. An electrophotographic photoconductor comprising at least an undercoat layer and a photosensitive layer sequentially formed over a conductive substrate, wherein the undercoat layer contains a cyclohexane dimethanol-diaryl ester compound represented by the formula (I):

(I)

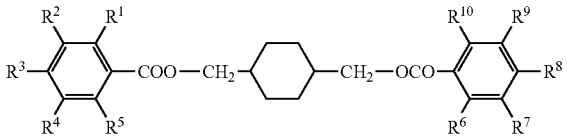

in formula (I), each of $R^1$ through $R^{10}$ represents, independently, a hydrogen atom, a halogen atom, a substituted or unsubstituted alkyl group of carbon number of from 1 to 5, a substituted or unsubstituted aryl group, or a substituted or unsubstituted alkoxy group of carbon number of from 1 to 5.

10. The electrophotographic photoconductor according to claim 9, wherein the cyclohexane dimethanol-diaryl ester compound has a structure represented by the structural formula (I-1):

(I-1)

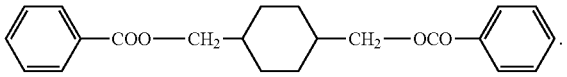

11. The electrophotographic photoconductor according to claim 9, wherein the cyclohexane dimethanol-diaryl ester compound has a structure represented by the structural formula (I-2):

(I-2)

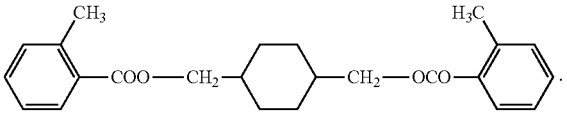

12. The electrophotographic photoconductor according to claim 9, wherein the cyclohexane dimethanol-diaryl ester compound is contained in an amount in the range of 0.1 parts by weight to 30 parts by weight with respect to 100 parts by weight of a resin binder in a layer that contains the cyclohexane dimethanol-diaryl ester compound.

13. A method of manufacturing the electrophotographic photoconductor according to claim 9, the method comprising:

providing the conductive substrate;

applying a coating liquid over the conductive substrate to form the undercoat layer, wherein the coating liquid contains the cyclohexane dimethanol-diaryl ester compound represented by the formula (I-1); and forming the photosensitive layer on the undercoat layer.

14. An electrophotographic photoconductor comprising at least a photosensitive layer and a surface protection layer sequentially formed over a conductive substrate, wherein the surface protection layer contains a cyclohexane dimethanol-diaryl ester compound represented by the formula (I):

(I)

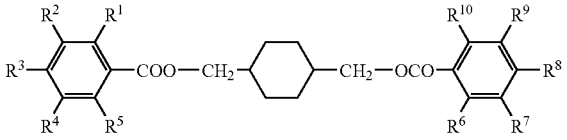

in formula (I), each of $R^1$ through $R^{10}$ represents, independently, a hydrogen atom, a halogen atom, a substituted or unsubstituted alkyl group of carbon number of from 1 to 5, a substituted or unsubstituted aryl group, or a substituted or unsubstituted alkoxy group of carbon number of from 1 to 5.

15. The electrophotographic photoconductor according to claim 14, wherein the cyclohexane dimethanol-diaryl ester compound has a structure represented by the structural formula (I-1):

(I-1)

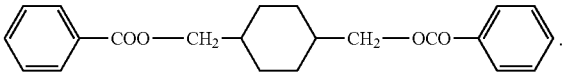

16. The electrophotographic photoconductor according to claim 14, wherein the cyclohexane dimethanol-diaryl ester compound has a structure represented by the structural formula (I-2):

(I-2)

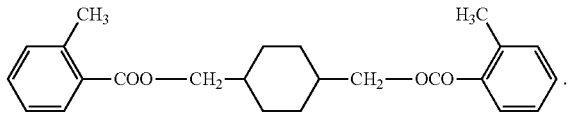

17. The electrophotographic photoconductor according to claim 14, wherein the cyclohexane dimethanol-diaryl ester compound is contained in an amount in the range of 0.1 parts by weight to 30 parts by weight with respect to 100 parts by weight of a resin binder in a layer that contains the cyclohexane dimethanol-diaryl ester compound.

18. A method of manufacturing the electrophotographic photoconductor according to claim 14, the method comprising:

providing the conductive substrate;

forming the photosensitive layer on the conductive substrate; and applying a coating liquid on the photosensitive layer to form the surface protection layer, wherein the coating liquid contains the cyclohexane dimethanol-diaryl ester compound represented by the formula (I-1).

* * * * *